US010927839B2

(12) United States Patent
Liu

(10) Patent No.: US 10,927,839 B2
(45) Date of Patent: Feb. 23, 2021

(54) INFLATION PUMP AND OPERATING METHOD AND USAGE OF THE SAME

(71) Applicant: Jiangsu Youmay Electric Appliance Co., Ltd., HuaiAn (CN)

(72) Inventor: Ying'an Liu, Jiangsu (CN)

(73) Assignee: JIANGSU YOUMAY ELECTRIC APPLIANCE CO., LTD., Jiangsu (CN)

( * ) Notice: Subject to any disclaimer, the term of this patent is extended or adjusted under 35 U.S.C. 154(b) by 446 days.

(21) Appl. No.: 15/771,155

(22) PCT Filed: Mar. 2, 2018

(86) PCT No.: PCT/CN2018/077906

§ 371 (c)(1),
(2) Date: Apr. 26, 2018

(87) PCT Pub. No.: WO2019/148573

PCT Pub. Date: Aug. 8, 2019

(65) Prior Publication Data

US 2020/0248706 A1 Aug. 6, 2020

(30) Foreign Application Priority Data

Feb. 1, 2018 (CN) ..... 201810104421.7

(51) Int. Cl.
*F04D 25/08* (2006.01)
*F04D 25/16* (2006.01)
*F04D 27/00* (2006.01)

(52) U.S. Cl.
CPC ..... *F04D 25/084* (2013.01); *F04D 25/08* (2013.01); *F04D 25/16* (2013.01); *F04D 27/007* (2013.01)

(58) Field of Classification Search
CPC .... F04D 13/06; F04D 13/068; F04D 13/0686; F04D 13/0693; F04D 25/06;
(Continued)

(56) References Cited

U.S. PATENT DOCUMENTS 8,636,481 B2 * 1/2014 Liu ..... F04B 39/10 417/410.1
8,863,771 B2 * 10/2014 Wang ..... F04D 25/166 137/565.17

(Continued)

*Primary Examiner* — Charles G Freay
*Assistant Examiner* — Chirag Jariwala
(74) *Attorney, Agent, or Firm* — Hogan Lovells US LLP

(57) ABSTRACT

An inflation pump and operating method and usage thereof relate to the technical field of inflation devices. The inflation pump includes a housing, a control mechanism and an inflation mechanism. Both the control mechanism and inflation mechanism are provided within the housing. The control mechanism includes a pressure sensor and a control circuit board. The pressure sensor communicates with the control circuit board via signals. The control circuit board communicates with the inflation mechanism via signals. The pressure sensor is communicated with outside of the housing through a first air pipe. The inflation mechanism is communicated with outside of the housing through an air inlet provided on the housing. It should be noted that the inflation pump automatically controls inflation mechanism via control mechanism, which solves the technical problem in the prior art that inflation pumps need to be manually shut down when the inflation requirements are reached, therefore, the present disclosure has a significant value in publicity and application.

17 Claims, 3 Drawing Sheets

(58) Field of Classification Search
CPC ..... F04D 25/0673; F04D 25/068; F04D 25/0693; F04D 25/08; F04D 25/084; F04D 25/086; F04D 25/12; F04D 29/002; F04D 25/16; F04D 27/007
USPC ..... 417/423.1, 423.14; 5/713
See application file for complete search history.

(56) References Cited

U.S. PATENT DOCUMENTS

| | | | | |
|---|---|---|---|---|
| 2008/0201857 | A1* | 8/2008 | Kelly | A47C 27/082 5/713 |
| 2018/0335042 | A1* | 11/2018 | Lin | F04D 27/008 |
| 2019/0211829 | A1* | 7/2019 | Huang | F04D 25/08 |

* cited by examiner

INFLATION PUMP AND OPERATING METHOD AND USAGE OF THE SAME

CROSS REFERENCE TO RELATED APPLICATIONS

The present disclosure claims the priority to the Chinese Patent Application No. 2018101044217, entitled "Inflation Pump", filed with SIPO on Feb. 1, 2018, which is incorporated herein by reference in its entirety.

TECHNICAL FIELD

The present disclosure relates to the technical field of inflation devices, and particularly to an inflation pump and an operating method and usage thereof.

BACKGROUND ART

Currently, inflatable products have become increasingly popular to consumers as they are portable and easy to be organized. The inflatable mattresses in the prior art have been free from the defect of bulkiness in the traditional mattresses. The inflatable mattresses can be placed either indoors or outdoors as one wishes. Moreover, the inflatable mattresses are portable and easy to be organized due to small volume after being deflated, which makes them applicable to households, or t used as temporary beds in homes when guests come, or used in offices for a nap, or applicable to a travel or a camping. With the production of the inflatable mattresses, the devices for inflating and deflating them are further introduced into the market.

Generally, the inflation devices in the prior art mainly include a pneumatic pump and an inflation valve acting as a switch of the pneumatic pump. When the inflation is desired, the switch is pressed to get the pneumatic pump to start work, and then the air enters the inflatable mattress from the inflation valve. When the inflation is completed, the switch is pressed to get the pneumatic pump to stop and the inflation valve to be closed. In this way, the inflation process is completed. When the deflation is desired, the switch is pressed to have the valve open, and then the pneumatic pump starts to work, such that the air is discharged from the interior of the inflatable mattress.

As the process of inflation and deflation is controlled manually, after the user selects an inflation rotary knob or a deflation rotary knob, the user can just wait until the inflation or the deflation of the inflatable mattress reaches a desired state; and then, he/she can rotate the rotary knob manually to stop the inflation or the deflation. Sometimes, the user might forget to turn off the switch of the pneumatic pump during an inflation process, but the inflatable mattress continues to be inflated, as a result of which the inflatable mattress will be damaged.

DISCLOSURE OF THE INVENTION

It is an object of the present disclosure to provide an inflation pump to address the technical problem in the prior art that the inflation pumps need to be shut down manually when the inflation requirements are met.

It is another object of the present disclosure to provide a method of operating the inflation pump which can demonstrate the operating process of the above inflation pump and highlight the beneficial features of the above inflation pump.

It is a further object of the present disclosure to provide usage of the inflation pump which applies the inflation pump to the inflatable mattresses, with each advantage of the above inflation pump as described above.

To achieve at least one of the above objects, the embodiments of the present disclosure provide the following technical solution.

An inflation pump includes a housing, a control mechanism and an inflation mechanism. Specifically, both of the control mechanism and the inflation mechanism are provided within the housing.

The control mechanism includes a pressure sensor and a control circuit board, the pressure sensor communicates with the control circuit board via the signals. The control circuit board communicates with the inflation mechanism via signals, the pressure sensor is communicated with outside of the housing through a first air pipe, and the inflation mechanism is communicated with the outside of the housing through an air inlet provided on the housing.

Furthermore, in the embodiments of the present disclosure, the above control mechanism further includes a rotary knob and an elastic sheet cover. The rotary knob is fixedly connected with the elastic sheet cover. The elastic sheet cover is provided thereon with a metal sheet in contact with the control circuit board. The control circuit board is provided thereon with a plurality of contacts. The rotary knob may drive the elastic sheet cover to rotate, so that the metal sheet will be brought into contact with different ones of the contacts. Thus, pressures at different levels can be set.

Furthermore, in the embodiments of the present disclosure, a panel is made to cover an opening of the housing. The panel is provided with air vents for allowing air to get in or out.

The rotary knob is provided on the panel. The panel is fixedly connected with the elastic sheet cover by screws. The metal sheet on the elastic sheet cover comes into contact with one of the contacts on the control circuit board, so that each of the contacts corresponds to one pressure value of the pressure sensor.

Furthermore, in the embodiments of the present disclosure, the above control mechanism further includes a one-way valve and a pushing assembly. The one-way valve is provided at the air inlet.

The rotary knob is connected with the pushing assembly in a transmission way. The rotary knob controls, through the pushing assembly, opening and closing of the one-way valve.

Furthermore, in the embodiments of the present disclosure, the above one-way valve is installed on the housing by a supporting seat, and a one-way valve plate of the one-way valve is located on one side of the supporting seat away from the housing. The supporting seat is provided with a through-hole. The one-way valve plate covers the through-hole.

A valve rod of the one-way valve passes through the supporting seat, and is fixedly connected with a push rod on the supporting seat. One end of the push rod away from the one-way valve is connected with the pushing assembly.

The push rod is sleeved thereon with a spiral spring, so as to provide an elastic restoring force for moving the one-way valve towards an interior of the housing.

Furthermore, in the embodiments of the present disclosure, the above pushing assembly includes a dial disc, a grooved wheel and a converter. The rotary knob is fixedly connected with the dial disc. The grooved wheel is fixedly connected with the converter. The dial disc cooperates with the grooved wheel. The converter is provided opposite to the one-way valve. And the converter is provided thereon with a switch structure cooperating with the one-way valve.

The rotary knob drives, through the dial disc, the grooved wheel, so as to bring the converter to rotate about an axis of the grooved wheel. The converter controls, through the switch structure, the opening and closing of the one-way valve.

Furthermore, in the embodiments of the present disclosure, the above grooved wheel is provided with two dial grooves, and the dial disc is provided thereon with two dial columns cooperating with the dial grooves.

When the switch structure is in a closed status, the dial columns are engaged with the dial grooves.

Furthermore, in the embodiments of the present disclosure, the above dial disc is located on one side of the elastic sheet cover away from the panel and is fixedly connected with the rotary knob by screws. The dial columns are provided on a corresponding lower end face of the dial disc.

Furthermore, in the embodiments of the present disclosure, the above switch structure includes an arc-shaped bulge provided on a periphery of the converter. One end of the one-way valve comes into contact with a circumferential face of the converter and is located at one side of the arc-shaped bulge.

Furthermore, in the embodiments of the present disclosure, the above arc-shaped bulge is provided on one side of the converter opposite to the one-way valve. The valve rod in the one-way valve comes into contact with the converter 8 via the push rod. And one end of the push rod is located on one side of the arc-shaped bulge.

Furthermore, in the embodiments of the present disclosure, the above inflation mechanism includes an electric motor, fan blades and a plurality of separation plates. The plurality of separation plates are all provided within the housing and divide the housing into a first chamber and a second chamber. The plurality of separation plates are connected to form a third chamber. The separation plates are provided with openings for communicating the second chamber with the third chamber.

The fan blades are provided at the third chamber. The electric motor is located in the second chamber and is connected with the fan blades in a transmission way. The converter is provided in the third chamber. The converter is configured to control communication and disconnection of the third chamber with the first chamber and the second chamber.

Furthermore, in the embodiments of the present disclosure, an air passage is provided in the above converter. The air passage runs through a circumferential face of the converter and an end face of the converter opposite to the grooved wheel.

Furthermore, in the embodiments of the present disclosure, the above converter has a rotator at a middle portion of the converter. The rotator is cylindrical. An upper end of the rotator is fixedly connected with the grooved wheel by screws.

A first closure plate is provided at one end of the rotator close to the grooved wheel. A second closure plate is provided at one end of the rotator away from the grooved wheel. An arc-shaped bulge is provided on the second closure plate. A circumferential face of the rotator is provided thereon with a ventilation hood. A cross section of the ventilation hood is fan-shaped. Both side walls of the ventilation hood are fixedly connected with the first closure plate, the second closure plate and the rotator. An arc-shaped face of the ventilation hood away from the rotator is provided with air vents. The air vents on the arc-shaped face and the arc-shaped bulge are located on two opposite sides of the rotator. The first closure plate is provided, at a position corresponding to the ventilation hood, with air vents opening into the ventilation hood, thereby forming an air flow passage.

Furthermore, in the embodiments of the present disclosure, a cylindrical cavity is provided in the third chamber. The converter is located within the cylindrical cavity. A circumferential face of the first closure plate, a circumferential face of the second closure plate and the arc-shaped face of the ventilation hood all come into contact with the inner wall of the cylindrical cavity. A gap is formed between a portion of the rotator where the ventilation hood is not provided and the inner wall of the cylindrical cavity.

Furthermore, in the embodiments of the present disclosure, the above inflation pump further includes an air release valve. The air release valve is provided within the housing.

The control circuit board communicates with the air release valve via signals, and the air release valve is communicated with the outside of the housing via a second air pipe.

Furthermore, in the embodiments of the present disclosure, the above inflation pump further includes an air supplement pump. The air supplement pump is provided within the housing.

The control circuit board communicates with the air supplement pump via signals, and the air supplement pump is communicated with the outside of the housing via a third air pipe.

A method of operating the above inflation pump includes:

making, when the inflation pump is used to inflate an object, both the air inlet and the first air pipe communicating with the interior of the inflated object;

using the inflation mechanism to introduce, through the air inlet, air into the inflated object, and meanwhile, using the pressure sensor to sense a pressure in the inflated object; and the pressure sensor, when detecting that the pressure in the inflated object reaches a preset value, sending a signal to the control circuit board, and the control circuit board controlling the inflation mechanism to stop inflating.

Usage of the above inflation pump to an inflatable mattress includes:

providing the housing within the inflatable mattress and positioning both the air inlet and the through-hole on the housing within the inflatable mattress;

making the panel fixedly connected with the inflatable mattress, positioning the rotary knob outside the inflatable mattress, and setting an inflating pressure for the inflatable mattress or deflating the inflatable mattress via the rotary knob;

sensing, during use of the inflatable mattress, by the pressure sensor, a pressure in the inflatable mattress in real time, and adjusting the pressure in the inflatable mattress via the air release valve and the air supplement pump.

The inflation pump and the operating method and the usage thereof provided by the embodiments of the present disclosure provide the following beneficial effects. The inflation pump includes a housing, a control mechanism and an inflation mechanism. Both the control mechanism and the inflation mechanism are provided within the housing. The control mechanism includes a pressure sensor and a control circuit board. The pressure sensor communicates with the control circuit board via signals. The control circuit board communicates with the inflation mechanism via signals. The pressure sensor is communicated with the outside of the housing through a first air pipe.

The inflation mechanism is communicated with the outside of the housing through an air inlet provided on the housing. When the inflation pump provided by the embodiments of the present disclosure is used to inflate an object, both the air inlet and the first air pipe are communicated with the interior of the inflated object. The inflation mechanism introduces the air into the inflated object via the air inlet. In the meanwhile, the pressure sensor senses the pressure in the inflated object. When detecting that the pressure in the inflated object reaches a preset value, the pressure sensor sends a signal to the control circuit board. The control circuit board controls the inflation mechanism to stop inflating, so as to prevent the inflated object from damage. Thus, the inflation pump and operating method thereof as well as usage thereof which applies the inflation pump to the inflatable mattresses provided by the embodiments of the present disclosure effectively address the technical problem in the prior art that the inflation pumps need to be manually shut down when the inflation requirements are met. Therefore, the present disclosure has a significant value in publicity and application.

BRIEF DESCRIPTION OF DRAWINGS

In order to more clearly explain the technical solutions in the embodiments of the present disclosure or the prior art, figures to be used in description of the embodiments or the prior art will be briefly described. Obviously, the figures in the following description merely show some of the embodiments of the present disclosure. Other figures may be obtained by those ordinarily skilled in the art based on these figures without paying creative efforts.

Reference signs: 1—housing; 110—air inlet; 120—panel; 2—control circuit board; 3—rotary knob; 4—elastic sheet cover; 5—one-way valve plate; 51—supporting seat; 52—spiral spring; 6—dial disc; 7—grooved wheel; 8—converter; 81—arc-shaped bulge; 82—ventilation hood; 9—electric motor; 10—fan blade; 11—separation plate; 13—air release valve; 14—air supplement pump.

DETAILED DESCRIPTION OF EMBODIMENTS

Now the technical solutions of the present disclosure will be clearly and completely described with reference to the figures. Apparently, the embodiments described are merely some but not all of the embodiments of the present disclosure. All the other embodiments obtained by those ordinarily skilled in the art based on the embodiments provided in the present disclosure without any creative efforts shall fall within the scope of protection of the present disclosure.

It is to be noted that in the description of the present disclosure, orientation or positional relations indicated by terms such as "center", "upper", "lower", "left", "right", "vertical", "horizontal", "inner" and "outer" are the orientation or positional relations shown based on the figures, only for facilitating and simplifying description of the present disclosure, rather than indicating or implying that the referred devices or elements must be in a particular orientation or constructed or operated in the particular orientation, and therefore they should not be construed as limiting the present disclosure. In addition, terms like "first", "second" and "third" are merely used for descriptive purpose, and should not be construed as indicating or implying relative importance.

It should also be noted that, in the present disclosure, terms like "mount", "couple" and "connect" should be interpreted in a broad sense, unless otherwise explicitly specified and defined. For example, a connection may be fixed, detachable, or integrated, or it may be mechanical or electrical, or it may be direct or indirect via an intermediate medium, or it may be inside communication between two elements. Those ordinarily skilled in the art can understand the specific meanings of the above terms in the present disclosure according to specific circumstances.

Figure 1:
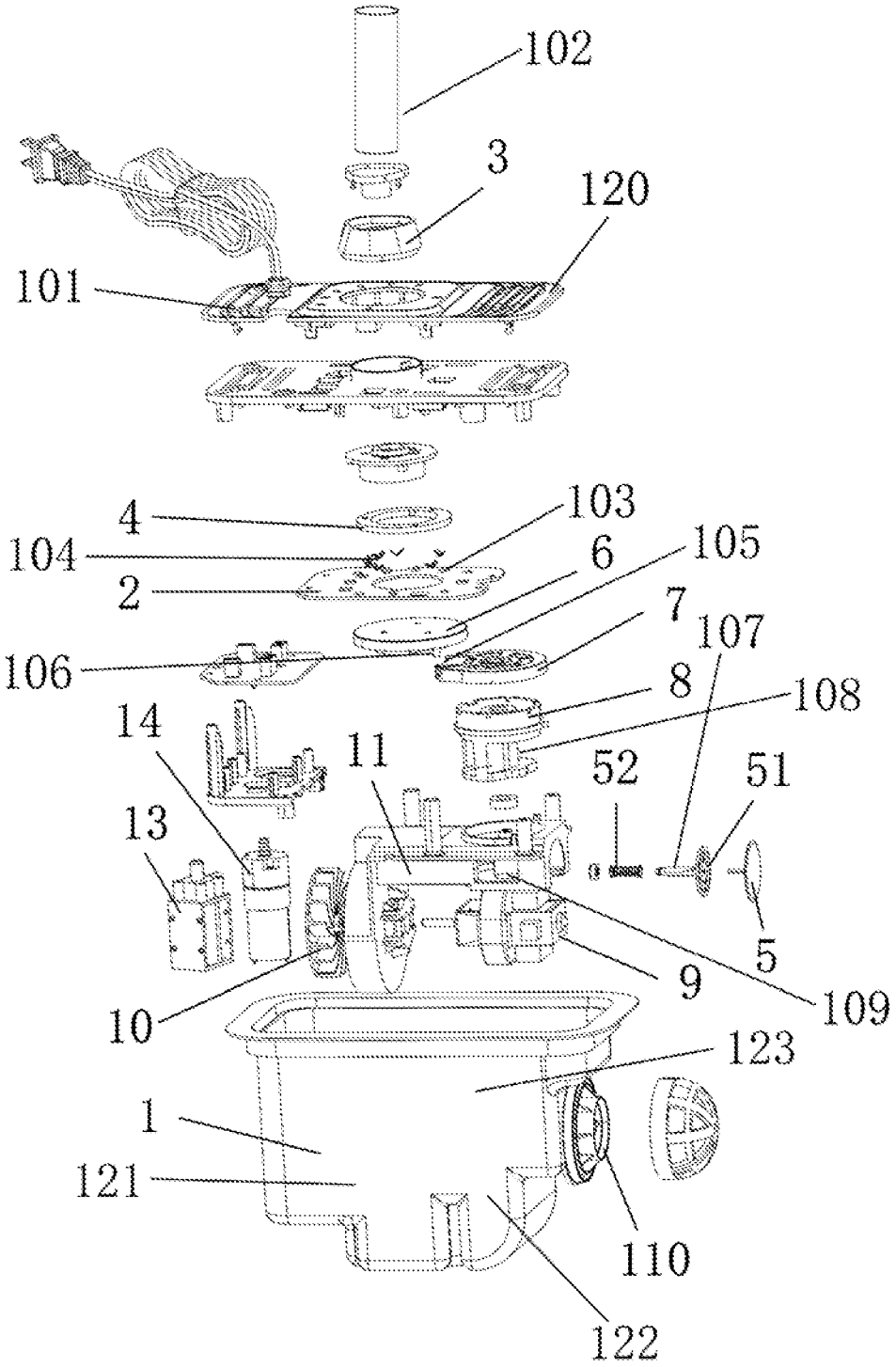
FIG. 1 is an explosive view of an inflation pump provided by an embodiment of the present disclosure.

FIG. 1 is an exploded view of an inflation pump provided by embodiments of the present disclosure. As shown in FIG. 1, the inflation pump provided by the embodiments of the present disclosure includes a housing 1, a control mechanism and an inflation mechanism. Both the control mechanism and the inflation mechanism are provided within the housing 1. The control mechanism includes a pressure sensor and a control circuit board 2. The pressure sensor communicates with the control circuit board 2 via signals. The control circuit board 2 communicates with the inflation mechanism via signals. The pressure sensor is communicated with the outside of the housing 1 through a first air pipe 102. The inflation mechanism is communicated with the outside of the housing 1 through an air inlet 110 provided on the housing 1.

Furthermore, the control mechanism further includes a rotary knob 3 and an elastic sheet cover 4. The rotary knob 3 is fixedly connected with the elastic sheet cover 4. The elastic sheet cover 4 is provided thereon with metal sheets 104 in contact with the control circuit board 2. The control circuit board 2 is provided thereon with a plurality of contacts 103. The rotary knob 3 can drive the elastic sheet cover 4 to rotate, so that the metal sheets 104 will be brought into contact with different contacts. Thus, pressures at different levels can be set.

As shown in FIG. 1, the housing 1 is made to cover an opening thereof with a panel 120. The panel 120 is provided with air vents 101. The air vents 101 are configured to introduce outside air to enter the inflation pump or to discharge the air in the inflation pump to the outside. The rotary knob 3 is provided on the panel 120. The panel 120 has marks indicating inflation levels, shutdown and deflation. The rotary knob 3 is provided with an indicating line. The rotary knob 3 is fixedly connected with the elastic sheet cover 4 by screws. The metal sheets 104 on the elastic sheet cover 4 comes into contact with one of the contacts on the control circuit board 2. Each contact corresponds to one pressure value of the pressure sensor. The rotary knob 3 is rotated until the indicating line is aligned with the mark corresponding to a respective position or level, the metal sheet is brought into contact with the contact corresponding to the respective position or level, and the control circuit board 2 sends signals indicating the set pressure value to the pressure sensor. When the pressure sensor senses that the pressure within the inflated object reaches a set value, signals will be sent to the control circuit board 2 and the control circuit board 2 will cause the inflation mechanism to stop inflating. Thus, stepless level shift is realized by controlling the inflation level with the rotary knob 3.

Furthermore, the control mechanism further includes a one-way valve and a pushing assembly. The one-way valve is provided at the air inlet 110. The rotary knob 3 is connected with the pushing assembly in a transmission way. The rotary knob 3 controls the opening and closing of the one-way valve via the pushing assembly.

Figure 2:
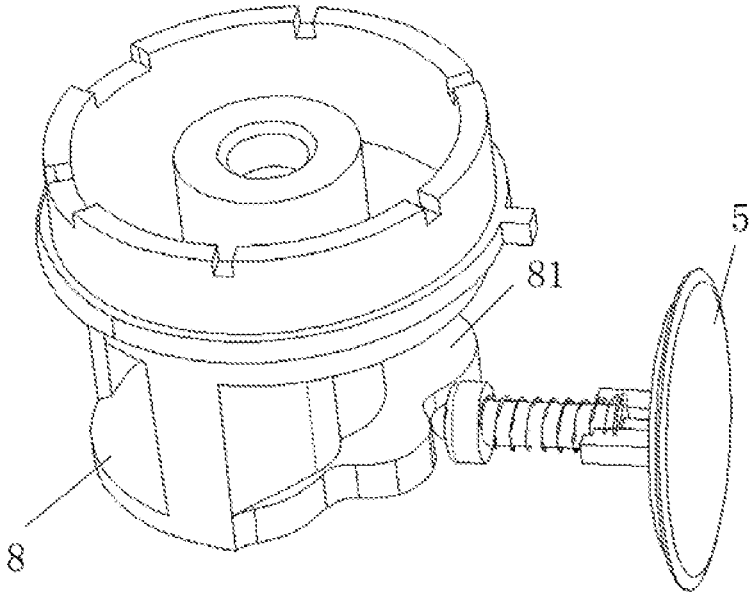
FIG. 2 is a schematic view of a converter in engagement with a one-way valve of the inflation pump provided by an embodiment of the present disclosure.

As shown in FIG. 2, the one-way valve is installed on the housing 1 via a supporting seat 51. The one-way valve plate 5 of the one-way valve is located on one side of the supporting seat 51 away from the housing 1. The supporting seat 51 is provided with through-holes. The one-way valve plate 5 is made of rubber and covers on the through-holes. The valve rod of the one-way valve passes through the supporting seat 51, and the valve rod is fixedly connected with the push rod 107 on the supporting seat 51. One end of the push rod 107 away from the one-way valve is connected with the pushing assembly. The push rod 107 is sleeved thereon with a spiral spring 52.

During an inflation process, the air deforms the one-way valve plate 5, and the air enters the inflated object through the through-hole on the supporting seat 51. During a deflation process, the rotary knob 3 brings the pushing assembly to move. Then the pushing assembly pushes the push rod 107 to move toward the one-way valve plate 5, and the push rod 107 pushes the one-way valve to move towards the outside of the housing 1, so as to open the one-way valve. In the meantime, the spiral spring 52 is in a compressed state. When the control mechanism returns to an original status, the one-way valve moves towards the inside of the housing 1 under an action of restoring force of the spiral spring 52, so as to close the one-way valve. The provision of the pushing assembly and the one-way valve makes it possible to control the opening and closing of the air inlet 110 by the rotary knob 3.

Furthermore, the pushing assembly includes a dial disc 6, a grooved wheel 7 and a converter 8. The rotary knob 3 is fixedly connected with the dial disc 6. The grooved wheel 7 is fixedly connected with the converter 8. The dial disc 6 cooperates with the grooved wheel 7. The converter 8 is provided opposite to the one-way valve and the converter 8 is provided thereon with a switch structure, with the switch structure cooperating with the one-way valve. The rotary knob 3 drives the grooved wheel 7 through the dial disc 6, so as to bring the converter 8 to rotate about an axis of the grooved wheel 7. The converter 8 controls the opening and closing of the one-way valve through the switch structure.

As shown in FIG. 1, the dial disc 6 is located on one side of the elastic sheet cover 4 away from the panel 120 and is fixedly connected with the rotary knob 3 through screws. A lower end face of the dial disc 6 is provided with two dial columns 106 which cooperate with the grooved wheel 7. As shown in FIG. 1, the grooved wheel 7 is provided on the right of the dial disc. The grooved wheel 7 is provided with two dial grooves 105. The converter 8 is located below the grooved wheel 7 and is fixedly connected with the grooved wheel 7 through screws.

When the rotary knob 3 is in an off position, the two dial columns 106 are respectively engaged with the two dial grooves 105. The switch structure keeps the one-way valve closed. Viewing the panel 120 from the outside of the inflation pump, when the rotary knob 3 is rotated clockwise based on the orientation shown in FIG. 1 to the low level, the elastic sheet cover 4 and the dial disc 6 are rotated in the same direction as the rotary knob 3, and meanwhile, the dial disc 6 dials the grooved wheel 7 to rotate counterclockwise and the dial columns 106 separate from the dial grooves 105, then the grooved wheel 7 bring the converter 8 to rotate and the air in the inflation pump deforms the one-way valve plate 5, so that the air in the inflation pump enters the inflated object through the air inlet 110. The rotary knob 3 is further rotated to the medium level, the elastic sheet cover 4 and the dial disc 6 are rotated along with the rotary knob 3, but the grooved wheel 7 and the converter 8 are not rotated, so the one-way valve remains open, and the control circuit board 2 alters the pressure sensing setting of the pressure sensor. The rotary knob 3 is further rotated to the high level, the elastic sheet cover 4 and the dial disc 6 are rotated along with the rotary knob 3, but the grooved wheel 7 and the converter 8 are not rotated, so the one-way valve remains open, and the control circuit board 2 alters the pressure sensing setting of the pressure sensor. When the inflation pump is to be shut down, the rotary knob 3 is rotated counterclockwise. When the rotary knob 3 is rotated to the low level, the dial disc 6 is engaged with the grooved wheel 7, and the dial disc 6 brings the grooved wheel 7 and the converter 8 to rotate clockwise, until the grooved wheel 7 and the converter 8 return to the original position, so that the one-way valve is closed.

It should be noted that, specifically, when the inflation pump is shut down, if the rotary knob 3 is rotated counterclockwise from the inflation position to the off position, and in the meanwhile, the grooved wheel 7 and the converter 8 are rotated clockwise, then the one-way valve is in closed status. When the inflation pump is shut down, if the rotary knob 3 is rotated clockwise from the deflation position (in which case the one-way valve is in pushed-out status) to the off position, and in the meanwhile, the grooved wheel 7 and the converter 8 are rotated counterclockwise, then the one-way valve returns to its original status (i.e. the one-way valve is in the closed status). It should be emphasized that when the rotary knob 3 is rotated to an inflation position (e.g., low level, medium level, high level) or to the off position, the one-way valve is in the original position, namely, the one-way valve is not pushed out (air intake means that the one-way valve plate 5 is blown to be deformed by the air, namely, the air may enter the inflated object). When the rotary knob 3 is rotated to the deflation position, the one-way valve is in the pushed-out status, at which moment the air is discharged from the inside to the outside.

When the rotary knob 3 is rotated counterclockwise based on the orientation shown in FIG. 1 until deflation position, the elastic sheet cover 4 and the dial disc 6 are rotated in the same direction as the rotary knob 3; the control circuit board 2 alters the pressure sensing setting of the pressure sensor; meanwhile, the dial disc 6 dials the grooved wheel 7 to rotate clockwise, and the dial columns separate from the dial grooves; the grooved wheel 7 brings the converter 8 to rotate; the switch structure on the converter 8 keeps the one-way valve open, so that the air in the inflated object is discharged to the atmosphere by the inflation pump; when the pressure in the inflated object reaches the deflation pressure, the deflation stops.

Furthermore, the switch structure includes an arc-shaped bulge 81 provided on a periphery of the converter 8. One end of the one-way valve comes into contact with a circumferential face of the converter 8 and is located on one side of the arc-shaped bulge 81.

As shown in FIG. 2, the arc-shaped bulge 81 is provided on one side of the converter 8 opposite to the one-way valve. The valve rod in the one-way valve is connected with the converter 8 via the push rod. And one end of the push rod is located on one side of the arc-shaped bulge 81. During the deflation process, the converter 8 is rotated and the artshaped bulge 81 pushes the one-way valve through the push rod, so as to open the one-way valve. When the converter 8 is returned to its original position, the one-way valve closes.

Furthermore, the inflation mechanism includes an electric motor 9, fan blades 10 and a plurality of separation plates 11. The plurality of separation plates 11 are all provided within the housing 1 and divide the housing 1 into a first chamber 121 and a second chamber 122. The plurality of separation plates 11 are connected to form a third chamber 123. The separation plates are provided with openings 109 for communicating the second chamber 122 with the third chamber 123. The fan blades 10 are provided in the third chamber 123. The electric motor 9 is located in the second chamber 122 and is connected with the fan blades 10 in a transmission way. The converter 8 is provided in the third chamber 123. The converter 8 is configured to control the communication and disconnection of the third chamber 123 with the first chamber 121 and the second chamber 122.

Specifically, the first chamber 121 is communicated with both the outside of the housing 1 and the third chamber 123. The third chamber 123 is communicated with both the second chamber 122 and the air inlet 110. During the inflation process, the one-way valve is open; the electric motor 9 brings the fan blades 10 to rotate; the outside air enters the first chamber 121 through the air vents 101 on the panel 120; the air in the first chamber 121 enters the second chamber 122 via the converter 8; as the separation plates are provided with air vents where the electric motor 9 is connected with the fan blades 10, when the electric motor 9 drives the fan blades 10 to rotate, the air in the second chamber 122 enters the third chamber 123 and the air in the third chamber 123 enters the inflated object through the air inlet 110. During the deflation process, the one-way valve is open; the converter 8 disconnects the left end of the third chamber 123 from the right end of the third chamber 123; the air in the inflated object enters the third chamber 123 through the air inlet 110, and then enters the second chamber 122 through the openings on the separation plates; the electric motor 9 drives the fan blades 10 to rotate; the air in the second chamber 122 enters the third chamber 123; the air in the left end of the third chamber 123 enters the first chamber 121 via the converter 8; and the air in the first chamber 121 is discharged to the atmosphere through the air vents on the panel 120.

Furthermore, the converter 8 is provided with an air passage 108. The air passage 108 runs through the circumferential face of the converter 8 and an end face of the converter 8 opposite to the grooved wheel 7.

Figure 3:
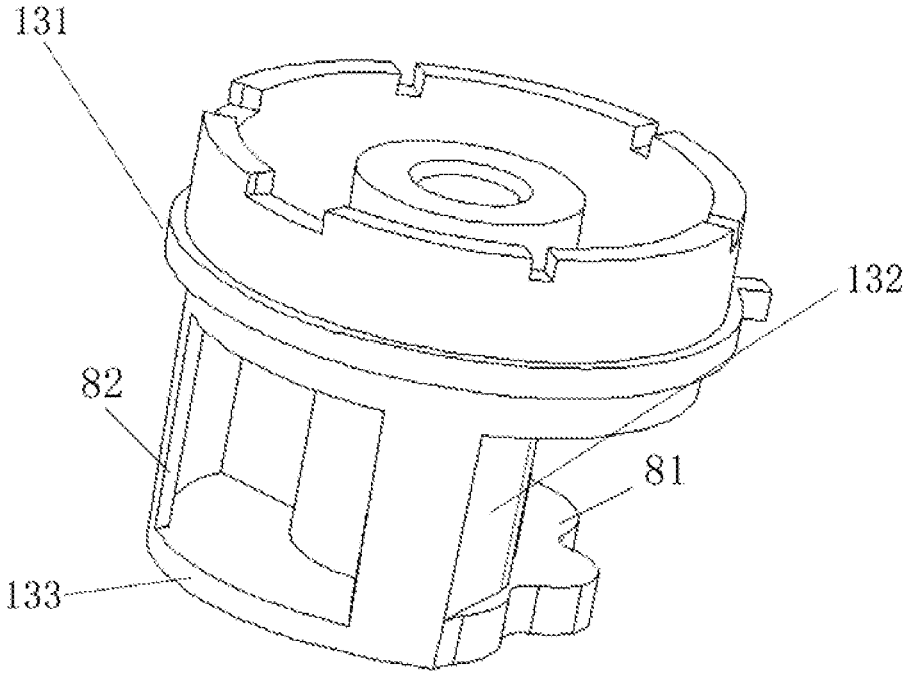
FIG. 3 is a schematic view of the converter of the inflation pump provided by an embodiment of the present disclosure.

As shown in FIG. 3, the converter 8 has a rotator 132 located at a middle portion of the converter, and the rotator 132 is cylindrical. An upper end of the rotator 132 is fixedly connected with the grooved wheel 7 by screws. A first closure plate 131 is provided at one end of the rotator 132 close to the grooved wheel 7, and a second closure plate 133 is provided at one end of the rotator 132 away from the grooved wheel 7. An arc-shaped bulge 81 is provided on the second closure plate 133. A circumferential face of the rotator 132 is provided thereon with a ventilation hood 82. A cross section of the ventilation hood 82 is fan-shaped. Both side walls of the ventilation hood 82 are fixedly connected with the first closure plate 131, the second closure plate 133 and the rotator 132. An arc-shaped face of the ventilation hood 82 away from the rotator 132 is provided with an air vent. The air vent on the arc-shaped face and the arc-shaped bulge 81 are located on two opposite sides of the rotator 132. The first closure plate 131 is provided, at a position corresponding to the ventilation hood 82, with air vents 141 opening into the ventilation hood 82, thereby forming an air flow passage.

Figure 4:
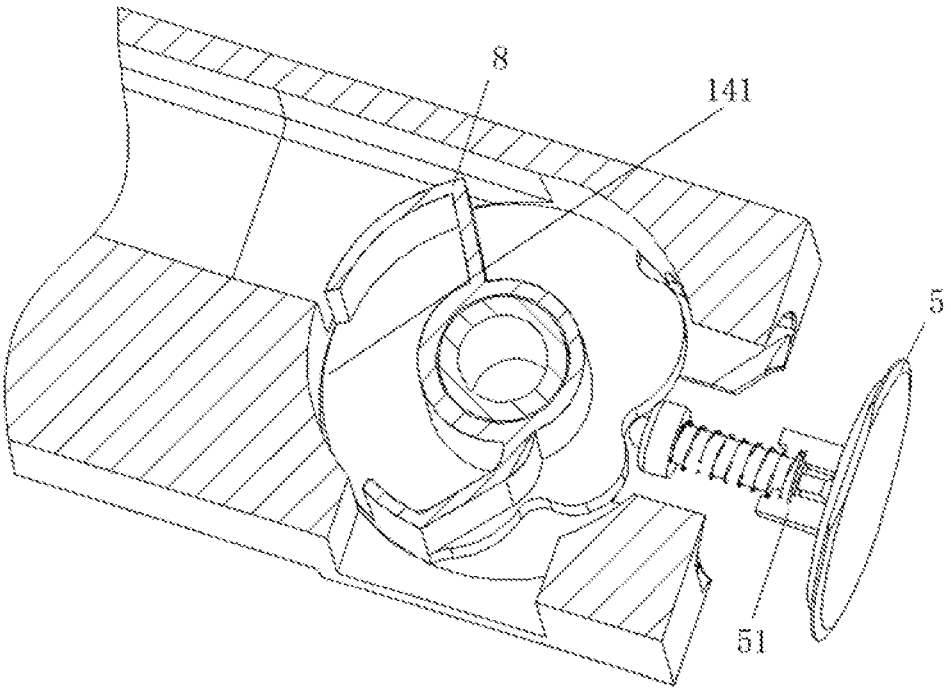
FIG. 4 is a schematic view of the converter in engagement with a third chamber of the inflation pump provided by an embodiment of the present disclosure.

As shown in FIG. 4, a cylindrical cavity is provided in the third chamber. The converter 8 is located within the cylindrical cavity. The circumferential face of the first closure plate 131, the circumferential face of the second closure plate 133 and the arc-shaped face of the ventilation hood 82 are all come into contact with the inner wall of the cylindrical cavity. A gap is formed between a portion of the rotator 132 where the ventilation hood 82 is not provided and the inner wall of the cylindrical cavity.

During the inflation process, the grooved wheel 7 brings the converter 8 to rotate. The opening on the ventilation hood 82 is opposite to the opening on the separation plate. The air in the first chamber enters the ventilation hood 82 through the opening on the first closure plate 131. The air within the ventilation hood 82 enters the second chamber through the opening on the separation plate; the electric motor 9 drives the fan blades 10 to rotate, and the air in the second chamber enters the third chamber; the air in the third chamber flows to the air inlet 110 through the gap between the converter 8 and the inner wall of the cylindrical cavity, and then enters the inflated object through the one-way valve. During the deflation process, the grooved wheel 7 brings the converter 8 to rotate; the ventilation hood 82 separates one end of the third chamber from the other end of the third chamber; the opening on the ventilation hood 82 is communicated with the left end of the third chamber; the portion of the converter 8 that has a gap with the inner wall of the cylindrical cavity is rotated to the position where the separation plate is provided with an opening; the arc-shaped bulge 81 forces the one-way valve to open; the air in the inflated object enters the third chamber through the air inlet 110 and enters the second chamber through the opening on the separation plate; the electric motor 9 drives the fan blades 10 to rotate, so that the air in the second chamber enters the third chamber from the left end of the third chamber; the air in the third chamber enters the ventilation hood 82 and enters the first chamber through the openings on the first closure plate 131; the air in the first chamber enters the atmosphere through the air vents on the board 120. A convertible structure makes it possible to control the mode of communication with the third chamber.

Furthermore, the inflation pump further includes an air release valve 13. The air release valve 13 is provided within the housing 1. The control circuit board 2 communicates with the air release valve 13 via signals. The air release valve 13 is communicated with the outside of the housing 1 through a second air pipe.

The air release valve 13 is provided within the first chamber. The housing 1 is provided with a through-hole. One end of the second air pipe is communicated with the through-hole, and the other end of the second air pip is communicated with the air release valve 13. When the rotary knob 3 is rotated from the high level to the low level, the set pressure decreases; the pressure sensor detects that the pressure is higher than the set value and sends signals indicating the detection result to the control circuit board 2; the control circuit board 2 controls the air release valve 13 to open, so as to deflate the inflated object; when the detected pressure equals the set value, the control circuit board 2 controls the air release valve 13 to close.

Furthermore, the inflation pump further includes an air supplement pump 14. The air supplement pump 14 is provided within the housing 1. The control circuit board 2 communicates with the air supplement pump 14 via signals.

The air supplement pump 14 is communicated with the outside of the housing 1 via a third air pipe.

The air supplement pump 14 is provided within the first chamber. The housing 1 is provided with a through-hole. One end of the third air pipe is communicated with the through-hole, and the other end of the third air pipe is communicated with the air supplement pump 14. The pressure sensor detects that the pressure is lower than the set value, and sends signals indicating the detection result to the control circuit board 2. The control circuit board 2 controls the air supplement pump 14 to turn on so as to supply more air. When the detected pressure equals the set value, the control circuit board 2 controls the air supplement pump 14 to turn off.

The provision of the air release valve 13 and the air supplement pump 14 makes it possible to keep the pressure in the inflated object within a required range, which facilitates the adjustment of the pressure in the inflated object.

As an implementation, the air holes include a first air hole, a second air hole and a third air hole. The first air pipe is communicated with the first air hole. The second air pipe is communicated with the second air hole. The third air pipe is communicated with the third air hole.

As another implementation, the air holes include a first air hole and a second air hole. Any two of the first air pipe, the second air pipe and the third air pipe are communicated with the first air hole via a fourth air pipe, and the remaining one is communicated with the second air hole.

Specifically, the first air pipe and the second air pipe are communicated with each other via the fourth air pipe; the fourth air pipe is communicated with the first air hole; the third air pipe is communicated with the second air hole; and each of the first air pipe and the second air pipe is provided with a solenoid valve. Alternatively, the second air pipe and the third air pipe are communicated with each other via the fourth air pipe; the fourth air pipe is communicated with the first air hole; the first air pipe is communicated with the second air hole; and each of the second air pipe and the third air pipe is provided with a solenoid valve. Alternatively, the first air pipe and the third air pipe are communicated with each other via the fourth air pipe; the fourth air pipe is communicated with the first air hole; the second air pipe is communicated with the second air hole; and each of the first air pipe and the third air pipe is provided with a solenoid valve. The control circuit board 2 communicates with the solenoid valves via signals, for controlling the opening and closing of the solenoid valve.

As an implementation, the air hole includes a first air hole. The first air pipe, the second air pipe and the third air pipe are communicated with the first air hole via the fourth air pipe.

Each of the first air pipe, the second air pipe and the third air pipe is provided with a solenoid valve. The control circuit board 2 communicates with the solenoid valves via signals, for controlling the opening and closing of the solenoid valve.

To sum up, the inflation pump provided by the embodiments of the present disclosure includes a housing 1, a control mechanism and an inflation mechanism. Both the control mechanism and the inflation mechanism are provided within the housing 1. The control mechanism includes a pressure sensor and a control circuit board 2. The pressure sensor communicates with the control circuit board 2 via signals. The control circuit board 2 communicates with the inflation mechanism via signals. The pressure sensor is communicated with the outside of the housing 1 via the first air pipe 102. The inflator mechanism is communicated with the outside of the housing 1 via the air inlet 110 provided on the housing 1.

It should be noted that the method of operating the inflation pump provided by the embodiments of the present disclosure is that: making, when the inflation pump provided by the embodiments of the present disclosure is used to inflate an object, both the air inlet 110 and the first air pipe 102 communicating with the interior of the inflated object; using the inflation mechanism to introduce, through the air inlet 110, air into the inflated object; in the meanwhile, using the pressure sensor to sense the pressure in the inflated object; and the pressure sensor, when detecting that the pressure in the inflated object reaches a preset value, sending a signal to the control circuit board 2; and the control circuit board 2 controlling the inflation mechanism to stop inflating, so as to prevent the inflated object from damage.

The embodiments of the present disclosure further provide usage of the above inflation pump. Particularly, the above inflation pump provided by the embodiments of the present disclosure is applied to inflatable mattress. Specifically, the usage includes: providing the housing 1 within the inflatable mattress and positioning both the air inlet 110 and the through-hole on the housing 1 within the inflatable mattress; making the panel 120 fixedly connected with the inflatable mattress, positioning the rotary knob 3 outside the inflatable mattress; and setting the inflating pressure for the inflatable mattress or deflating the inflatable mattress via the rotary knob 3; sensing, during use of the inflatable mattress, by the pressure sensor, the pressure in the inflatable mattress in real time, and adjusting the pressure in the inflatable mattress via the air release valve 13 and the air supplement pump 14.

It should be emphasized that, in other implementations, the inflation pump described by the embodiments of the present disclosure is not limited to the usage to inflatable mattresses, but the inflation pump may be applied to other inflatable products, such as inflatable pillows and inflatable seats.

As last, it should be noted that the above embodiments are provided only to explain the technical solutions of the present disclosure, rather than limiting the present disclosure. Although the present disclosure is described in details with reference to the aforementioned embodiments, those ordinarily skilled in the art should appreciate that modifications may still be made to the technical solutions contained in aforementioned embodiments, or equivalent replacements may be made to some or all of the technical features therein. Such modifications or replacements should not depart the essence of the respective technical solutions from the scope of the technical solutions in the various embodiments of the present disclosure.

INDUSTRIAL APPLICABILITY

The inflation pump and operating method and usage thereof provided by the embodiments of the present disclosure alleviate the technical problem in the prior art that the inflation pumps need to be manually shut down when the inflation requirements are reached. Therefore, the present disclosure has a significant value in publicity and application.

The invention claimed is:

1. An inflation pump, comprising a housing, a control mechanism and an inflation mechanism, wherein both the control mechanism and the inflation mechanism are provided within the housing, wherein the control mechanism comprises a pressure sensor and a control circuit board, the pressure sensor communicates with the control circuit board via signals, the control circuit board communicates with the inflation mechanism via signals, the pressure sensor is communicated with outside of the housing through a first air pipe, and the inflation mechanism is communicated with the outside of the housing through an air inlet provided on the housing, the control mechanism further comprises a rotary knob, a sheet cover, a one-way valve and a pushing assembly, wherein the pushing assembly comprises a dial disc, a grooved wheel and a converter, the rotary knob is fixedly connected with the dial disc, the grooved wheel is fixedly connected with the converter, the dial disc cooperates with the grooved wheel, the converter is provided opposite to the one-way valve, and the converter is provided thereon with a switch structure cooperating with the one-way valve; and the rotary knob drives, through the dial disc, the grooved wheel, so as to bring the converter to rotate about an axis of the grooved wheel, and the converter controls, through the switch structure, the opening and closing of the one-way valve.

2. The inflation pump according to claim 1, wherein the inflation pump further comprises an air release valve, the air release valve being provided within the housing;

the control circuit board communicates with the air release valve via signals, and the air release valve is communicated with the outside of the housing via a second air pipe.

3. The inflation pump according to claim 1, wherein the inflation pump further comprises an air supplement pump, the air supplement pump being provided within the housing;

the control circuit board communicates with the air supplement pump via signals, and the air supplement pump is communicated with the outside of the housing via an additional air pipe.

4. A method of operating the inflation pump according to claim 1, comprising:

making, when the inflation pump is used to inflate an object, both the air inlet and the first air pipe communicating with an interior of the inflated object;

using the inflation mechanism to introduce, through the air inlet, air into the inflated object, and meanwhile, using the pressure sensor to sense a pressure in the inflated object; and the pressure sensor, when detecting that the pressure in the inflated object reaches a preset value, sending a signal to the control circuit board, and the control circuit board controlling the inflation mechanism to stop inflating.

5. A method for inflating inflatable mattress by using the inflation pump according to claim 1, wherein the one-way valve is installed on the housing by a supporting seat, a one-way valve plate of the one-way valve is located on one side of the supporting seat away from the housing, the supporting seat is provided with a through-hole, and a panel is made to cover an opening of the housing, and the inflation pump further comprises an air release valve and an air supplement pump;

the method comprising:

providing the housing within the inflatable mattress and positioning both the air inlet and the through-hole on the housing within the inflatable mattress;

making the panel fixedly connected with the inflatable mattress, positioning the rotary knob outside the inflatable mattress, and setting an inflating pressure for the inflatable mattress or deflating the inflatable mattress via the rotary knob;

sensing, during use of the inflatable mattress, by the pressure sensor, a pressure in the inflatable mattress in real time, and adjusting the pressure in the inflatable mattress via the air release valve and the air supplement pump.

6. The inflation pump according to claim 1, wherein the grooved wheel is provided with two dial grooves, and the dial disc is provided thereon with two dial columns cooperating with the dial grooves; and when the switch structure is in a closed status, the dial columns are engaged with the dial grooves.

7. The inflation pump according to claim 6, wherein the dial disc is located on one side of the sheet cover away from the panel and is fixedly connected with the rotary knob, and the dial columns are provided on a corresponding lower end face of the dial disc.

8. The inflation pump according to claim 1, wherein the switch structure comprises an arc-shaped bulge provided on a periphery of the converter, and one end of the one-way valve comes into contact with a circumferential face of the converter and is located at one side of the arc-shaped bulge.

9. The inflation pump according to claim 8, wherein the arc-shaped bulge is provided on one side of the converter opposite to the one-way valve, the valve rod in the one-way valve comes into contact with the converter via the push rod, and one end of the push rod is located on one side of the arc-shaped bulge.

10. The inflation pump according to claim 1, wherein the rotary knob is fixedly connected with the sheet cover, the sheet cover is provided thereon with a metal sheet in contact with the control circuit board, the control circuit board is provided thereon with a plurality of contacts, the rotary knob is configured to drive the sheet cover to rotate, so that the metal sheet is brought into contact with one of the plurality of contacts, so as to set one level of pressure.

11. The inflation pump according to claim 10, wherein a panel is made to cover an opening of the housing, and the panel is provided with air vents for allowing air to get in or out;

the rotary knob is provided on the panel, the panel is fixedly connected with the sheet cover; the metal sheet on the sheet cover comes into contact with one of the contacts on the control circuit board, so that each of the contacts corresponds to one pressure value of the pressure sensor.

12. The inflation pump according to claim 11, wherein the one-way valve is provided at the air inlet;

the rotary knob is connected with the pushing assembly in a transmission way, and the rotary knob controls, through the pushing assembly, opening and closing of the one-way valve.

13. The inflation pump according to claim 12, wherein the one-way valve is installed on the housing by a supporting seat, a one-way valve plate of the one-way valve is located on one side of the supporting seat away from the housing, the supporting seat is provided with a through-hole, and the one-way valve plate covers the through-hole;

a valve rod of the one-way valve passes through the supporting seat and is fixedly connected with a push rod on the supporting seat, one end of the push rod away from the one-way valve is connected with the pushing assembly;

the push rod is sleeved thereon with a spiral spring, so as to provide restoring force for moving the one-way valve towards an interior of the housing.

14. The inflation pump according to claim 1, wherein the inflation mechanism comprises an electric motor, fan blades and a plurality of separation plates, the plurality of separation plates are all provided within the housing and divide the housing into a first chamber and a second chamber, the plurality of separation plates are connected to form a third chamber, and the separation plates are provided with openings for communicating the second chamber with the third chamber;

the fan blades are provided in the third chamber, the electrical motor is located in the second chamber and connected with the fan blades in a transmission way, the converter is provided in the third chamber, and the converter is configured to control communication and disconnection of the third chamber with the first chamber and the second chamber.

15. The inflation pump according to claim 14, wherein an air passage is provided in the converter, the air passage runs through a circumferential face of the converter and an end face of the converter opposite to the grooved wheel.

16. The inflation pump according to claim 15, wherein the converter has a rotator located at a middle portion of the converter, the rotator is cylindrical, and an upper end of the rotator is fixedly connected with the grooved wheel;

a first closure plate is provided at one end of the rotator close to the grooved wheel, a second closure plate is provided at one end of the rotator away from the grooved wheel, an arc-shaped bulge is provided on the second closure plate, a circumferential face of the rotator is provided with a ventilation hood, a cross section of the ventilation hood is fan-shaped, both side walls of the ventilation hood are fixedly connected with the first closure plate, the second plate board and the rotator, an arc-shaped face of the ventilation hood away from the rotator is provided with air vents, the air vents on the arc-shaped face and the arc-shaped bulge are located on two opposite sides of the rotator, the first closure plate is provided, at a position corresponding to the ventilation hood, with air vents opening into the ventilation hood, thereby forming an air flow passage.

17. The inflation pump according to claim 16, wherein a cylindrical cavity is provided in the third chamber, the converter is located within the cylindrical cavity, a circumferential face of the first closure plate, a circumferential face of the second closure plate and the arc-shaped face of the ventilation hood all come into contact with an inner wall of the cylindrical cavity, and a gap is formed between a portion of the rotator where the ventilation hood is not provided and the inner wall of the cylindrical cavity.

* * * * *